US005246078A

United States Patent [19]

Kryger et al.

[11] Patent Number: 5,246,078

[45] Date of Patent: Sep. 21, 1993

[54] PROTECTIVE DEVICE FOR THERMOCHEMICAL ICE PENETRATOR

[75] Inventors: John B. Kryger, Fountain Valley; James E. Eninger, Torrance; Lee R. Miller, Long Beach; Lee D. Bergerson, Fountain Valley; Richard L. Prossen, San Pedro, all of Calif.

[73] Assignee: TRW Inc., Redondo Beach, Calif.

[21] Appl. No.: 818,932

[22] Filed: Jan. 10, 1992

[51] Int. Cl.[5] ..... F25C 5/04

[52] U.S. Cl. ..... 175/18; 299/3

[58] Field of Search ..... 175/11, 14, 18; 299/3

[56] References Cited

U.S. PATENT DOCUMENTS 4,651,834 3/1987 Eninger et al. ..... 299/3 X 4,923,019 5/1990 Gammon ..... 175/18 X

*Primary Examiner*—William P. Neuder

*Attorney, Agent, or Firm*—Ronald M. Goldman; Sol L. Goldstein

[57] ABSTRACT

Improved ice penetrator apparatus includes protective apparatus for the thermochemical ice penetrator to prevent an undesired explosive sound producing chemical reaction between water and the material of said ice penetrator, particularly while the penetrator is resident in a buoy tube prior to release. The protective apparatus at least partially covers the thermochemical ice penetrator and forms a unitary assembly therewith. The characteristic of the protective material is such that it is nonreactive to the ice penetrator material, typically lithium and/or a sodium lithium alloy, and to water. The protective apparatus may assume any of a diving bell, clam shell and banana skin structural form.

14 Claims, 2 Drawing Sheets

PROTECTIVE DEVICE FOR THERMOCHEMICAL ICE PENETRATOR

FIELD OF THE INVENTION

This invention relates to thermochemical ice penetrators and, more particularly, to improved thermochemical ice penetrators having enhanced safe storage and handling characteristics.

BACKGROUND

To provide radio communications or signals from an undersea source, such as a submerged submarine, a radio antenna must be raised from that source to a position above the surface of the water to permit RF propagation into the overlying atmosphere. Communications buoys, carried in the submarine, serve in that function. As an example known to those skilled in this technology, a communication buoy may be released from a submerged submarine. The buoy conveniently floats to the surface carrying an antenna, and exposed the antenna to the atmosphere. Self contained RF equipment them transmits RF to a predesignated frequency carrying modulated with information to other radio stations listening on the transmitting frequency.

In Arctic regions, moreover, one is confronted with polar ice overlying the sea. The ice is a physical barrier to movement of any buoyant object from the under side and, like water, does not adequately propagate RF energy. For Arctic environments, thus, the communications buoy, more aptly referred to as the Arctic communications buoy, includes a penetrator for penetrating the ice and creating a passage through which an RF antenna may be raised from beneath the ice.

One type of ice penetrator that has gained acceptance in that application is of the thermochemical type. The ice penetrator uses heat generated by a thermochemical reaction between material of the penetrator and the ice to melt a hole through the ice. One reactant is water, which is at least partially supplied by the ice as it melts. The second reactant is the thermochemical material of the penetrator which reacts exothermally on contact with water. Such penetrator material is, typically, an alkali metal or an alloy containing a alkali metal, preferably lithium. The reaction products include lithium hydroxide, a solid that may dissolve in water, and hydrogen, a gas. The reaction products are pertinent to aspects of the present invention.

An excellent source of more detailed background of, structure to and applications for the present invention is found in the patent to Eninger, et. al., U.S. Pat. No. 4,651,834, granted Mar. 24, 1987, assigned to TRW Inc, the assignee of the improved ice penetrator herein described and this application. To avoid unnecessary repetition herein one should make reference to the Eninger, et. al. patent as that background information is incorporated by reference in this specification.

As may be noted in the Eninger Patent the geometry of the outer surface of the penetrator's front end therein illustrated possess somewhat flat or blunt shapes. Later designs for ice penetrators produced in accordance with the Eninger patent, however, are artillery shell shaped or, as alternatively viewed, bullet shaped in geometry, a shape which appears to enhance the penetrator's speed of penetration through ice without undue consumption of the penetrator's material.

Although successfully applied, it has been discovered that under certain circumstances the lithium penetrator has a serious drawback. If released from a depth of between 300 and 600 feet under the water surface, the penetrator produces an acoustic report, a somewhat loud explosion, on contact with the water. When used in military submarines such noise could alert enemy vessels to the submarine's presence with possible calamitous results. Importantly, should the explosion occur too close to the submarine damage to personnel and equipment could possibly result. The present invention eliminates that hazard. Moreover, should the compartment housing the penetrator, the buoy table, inadvertently become flooded with water while in a deeply submerged submarine, at the high pressure existing at such depths one conceives that a similar potential for damage could result. The present invention also eliminates that potential hazard.

The mechanics of the explosive reaction are not fully understood. It is believed, however, that at the high pressures existing at great ocean depths, the lithium penetrator generates more heat than it can safely dissipate in the water, eventually melting the lithium and/or causing the penetrator to break apart into many smaller pieces. As is known, lithium is more reactive in the molten state. A greater surface area of highly reactive lithium is thus exposed to the ocean water in a relatively short period of time, resulting in the very violent chemical reaction, an explosion. Should the penetrator include sodium, which is even more reactive in water than lithium alone, more intense reactions might occur.

An object of the present invention therefore is to prevent thermochemical ice penetrators from exploding when exposed to the ocean water at great depths;

An additional object of the invention is to provide an improved ice penetration apparatus that cannot cause acoustic reports;

A further object of the invention is to provide a safety mechanism for strong and handling lithium type ice penetrators or ice penetrators containing other more reactive metals, such as sodium, that are alloyed with lithium; and An additional object is to prevent undue fragmentation or melting of the ice penetrator before and during deployment.

SUMMARY OF THE INVENTION

In accordance with the foregoing objects the improved ice penetrator apparatus includes protective apparatus for the thermochemical ice penetrator to prevent an undesired explosive sound producing chemical reaction between water and the material of said ice penetrator, particularly while the ice penetrator is resident in a buoy tube prior to release. The protective apparatus of least partially covers or sheaths the thermochemical ice penetrator and forms a unitary assembly therewith. The protective material has a characteristic that it is non-reactive to the ice penetrator material, typically lithium and/or a sodium lithium alloy, and to water. Any water that might flood or leak into the buoy tube, thus, cannot react violently with the stored ice penetrator, even though, as example, the water is at the high pressure occurring at depths below 300 feet. The safety or protective apparatus thus enhances the usefulness of thermochemical type ice penetrators.

In one particular embodiment of the invention, the protective apparatus is a diving bell structure having a metal body, suitably stainless steel, that present an open ended receptacle, in which to snugly receive the ice penetrator. Any water as might enter the diving bell creates, in an initial exothermic reaction with the penetrator, a gas that forces additional water out of the receptacle, thereby extinguishing the reaction; producing, hence, a self limiting reaction.

In a second form of the invention a clam shell like structure encases the ice penetrator in a snug fit chamber. The separate portions of the clam shell are formed of Nylon material. A spring located within the clam shell provides a bias force to force the two shell portions away from one another and against the buoy tube walls. Upon deployment, the spring serves to detach the clam shell, which may then fall away so that the penetrator may function in the ice. Prior to deployement such water as may enter within the clam shell in this arrangement, as at the seam between the facing shell portions, produces, in addition to the gas, earlier discussed, another liquid reaction product, that dissolves in the water. Such liquid reaction product is non-reactive and, as greater concentrations of that reaction product are formed within the water in the clamshell, the water to lithium reaction decreases to a very slow rate, resulting in a self limiting chemical reaction. The foregoing process avoids a fast acting violent reaction.

In a further embodiment the protective apparatus is a fluid tight container or wrap formed on the ice penetrator, suitably with plastic wrapping material and a wax overlayer, to form a unitary assembly that fits within the buoy tube of the ice penetrator apparatus. The wrap contains associated extending tabs that are fastened to the buoy tube. This apparatus is relatively easy to assemble and is formed of inexpensive components. The wrap prevents water from access to and, hence, precludes any reaction between water and the ice penetrator. The tabs serve to unwrap, essentially peel, the ice penetrator, like a banana, when the ice penetrator is forced out of the buoy tube while the tabs remain restrained by the buoy tube.

The foregoing and additional objects and advantages of the invention together with the structure characteristic thereof, which was only briefly summarized in the foregoing passages, becomes more apparent to those skilled in the art upon reading the detailed description of the preferred embodiments, which follows in this specification, taken together with the illustrations thereof presented in the accompanying drawings.

DETAILED DESCRIPTION OF THE PREFERRED EMBODIMENTS

The present invention improves upon ice penetrator systems that use a thermochemical penetrator of pure lithium. It appears to be of even greater benefit in those improved ice penetrators that incorporate sodium, which is more reactive with water than lithium, as an alloy, and are generally described in U.S. Pat. No. 4,651,834, to Eninger et al.

Preliminary to study of this detailed description, reference is made initially to column 19 line 27 through column 30 line 40 of the specification and to FIGS. 19–30 of the drawings of patent U.S. Pat. No. 4,651,834, granted Mar. 24, 1987, to Eninger et al., hereafter some times referred to as the Eninger patent. The Eninger patent describes the physical construction of and alternative designs for ice penetrator apparatus containing flotation devices by which vertically upwardly directed ice penetration is achieved through the polar ice and in which antennas, rigid telescoping or reeled, are shown to be carried and/or pulled from a location in the water underlying an ice flow to a location above the ice flow so that the antenna is exposed to the atmosphere. Such illustrations and description are referred to and are incorporated herewithin as part of the detailed description of the present invention and may be used to provide additional basis to elements in the claims appended to this application. While the entirety of the cited patent is incorporated herewithin, the foregoing sections specifically identified are especially pertinent.

Figure 1:
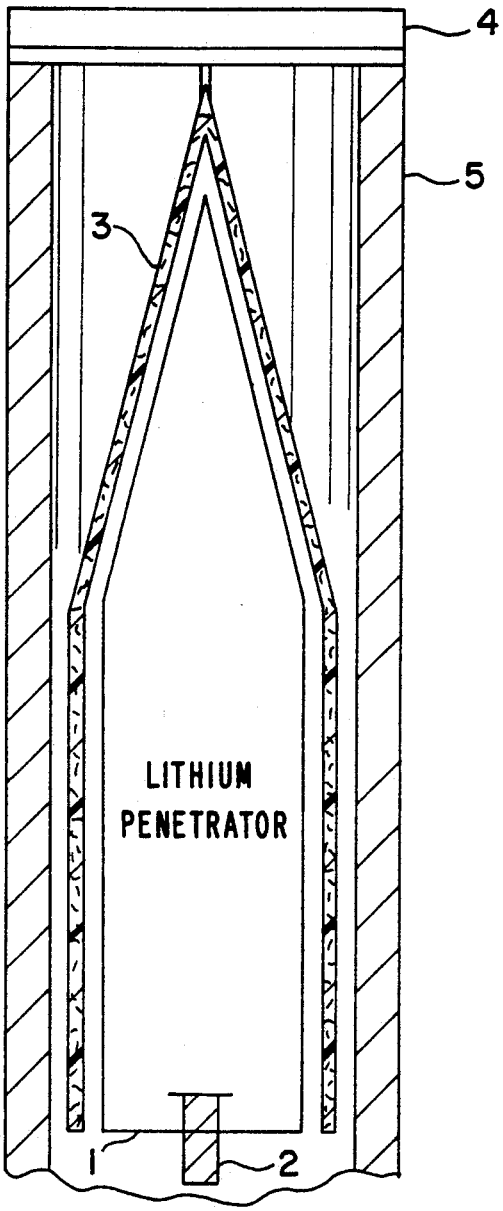
FIG. 1 illustrates in section view a first diving bell embodiment of the invention.

Referring now to FIG. 1, an ice penetrator 1, suitably of a bullet shape, containing a generally cylindrical portion and at its front end a cone shaped portion, is ensheathed or covered by a solid body or shell 3 also of bullet shape, sometimes referred to as a "diving bell", whose inner volume and geometry conforms to the outer geometry of penetrator 1 so as to snugly fit over the ice penetrator with slight clearance and, like a sheath, cover all but the penetrator's bottom end. The penetrator includes a base 2 for attachment to an antenna, not illustrated, as described in the Eninger Patent. Base member 2 is formed of a material that does not react with the lithium and/or lithium sodium alloys, suitably stainless steel, to provide a suitable anchor.

At most the spacing between the sides of the penetrator and the inner cylindrical surface of the shell 3 should be no more than 40 mils in clearance, a slight crack. As is apparent any such crack is exposed to the ambient in the area surrounding the bottom end of the shell as illustrated with some exaggeration in the figure.

The diving bell shell is formed of a material that does not react chemically with the material of the penetrator or with water; it is non-reactive in this context. With a lithium penetrator, one material of that desired characteristic is stainless steel. Aluminum, as example, should not be used for the shell in that instance, since aluminum reacts with lithium. The shell is formed by any suitable known technique, such as by molding and/or forging. The details of such forming processes, however, are known to those skilled in the art and need not be further described.

To assemble, ice penetrator 1 is inserted into the shell, which serves as a receptacle, at the latter's open end. That open end also allows the penetrator to easily be removed for deployment. External packaging, not illustrated, is used to retain the penetrator within the shell in inventory until such time as the penetrator is placed in a buoy tube for deployment.

The assembly is then placed within the cylindrical buoy tube 5, partially illustrated in this figure. As is apparent the protective cover essentially functions like a diving bell. If for any reason water leaks into or floods the buoy tube, the water chemically reacts with the lithium to form hydrogen gas. The hydrogen begins to fill the clearance space within the diving bell. As greater amounts of hydrogen gas is formed, the gas begins to force the water out of the clearance space due to hydrostatic pressure and, eventually, forces all water out of the space. With no water remaining the water and lithium reaction extinguishes. Effectively the protective covering causes the chemical reaction between water and lithium to be self limiting; the reaction starts initially, but soon stops before any explosion occurs.

When the improved thermal ice penetrator of this embodiment is inserted in the buoy tue for deployment, an end cap, 4, is provided at the front end and connected to the diving bell. For deployment, the end cap and diving bell connected to it, are expelled from the buoy tube propelled by compressed carbon dioxide released from an associated carbon dioxide cartridge, which is conventional in these systems and is not illustrated or further described. The penetrator assembly is now free to ascend through the water and into the ice by a force applied by an extendable mast, not shown.

Figure 2:
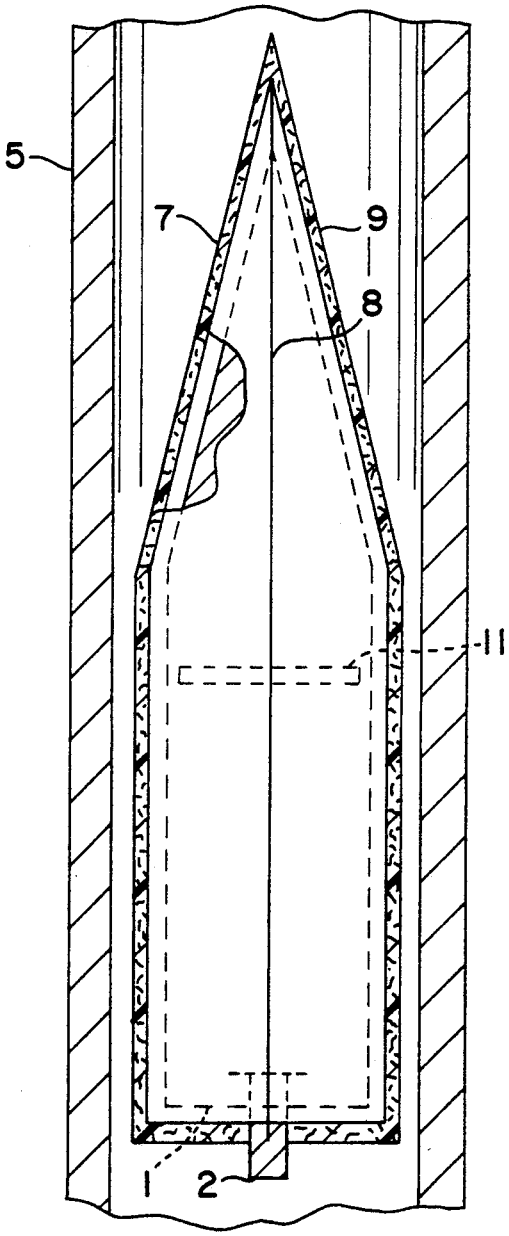
FIG. 2 illustrates in section view a second clam shell embodiment of the invention.

The alternative embodiment of FIG. 2 illustrates in partial view a clam shell arrangement, formed of elements 7 and 9, which encloses ice penetrator 1. In this arrangement two shell portions 7 and 9 matingly fit together along an axially extending edge 8 to define a confining volume or region of a shape and size that corresponds to the outer geometry and size of ice penetrator 1 and, when closed as illustrated in the figure, completely covers all sides of the penetrator, excepting base member 2, with a snug fit to serve as protective housing. In a general sense, the clam shell halves in this embodiment may be obtained by cutting the diving bell embodiment of FIG. 1 along the axis in half and welding a half moon shaped disk of the same material to the bottom end of each half. However instead of the metal, a non-metal is preferred as described hereafter.

The internal clearance between clam shell and penetrator, preferably, is no greater than 20 mils. Moreover the fit between the clam shell halves need not be and is not air or fluid tight, the significance of which becomes more apparent from the discussion of operation, which follows hereinafter. Suitably the shell portions are formed of Nylon material, which is non-reactive to lithium and to like metals in the same column of the periodic table of elements. The nylon gives a lower drag coefficient on contact with the metal of cylindrical buoy tube 5 in which the protected unit is installed and stored pending deployment. A thin strip of spring steel 11, suitably stainless steel, is wrapped halfway around the penetrator and fits between the penetrator and the clamshell halves. As example in one practical embodiment the spring may be one half inch in width, 0.01 inches thick and six inches in length.

As is apparent the clam shell halves are not fastened together by any fastening device or latch to better ensure that the halves easily fall away from the penetrator on deployment. The unit is assembled by hand with the assembler depositing the spring and penetrator in one half and then placing the remaining half in position, manually pushing against the bias of the spring. While so compressing the clam shell halves together the assembler may insert the penetrator assembly within the buoy tube. Since the diameter of the buoy tube's inner cylindrical walls is not much greater than the outer diameter of the penetrator assembly, the buoy tube walls thereby prevent the shell halves from significant separation, awaiting deployment.

Spring 11 exerts a separating force on the two halves of the clam shell, pushing the two portions against the inside surface of the buoy tube. During deployment, the assembly is forced out of the buoy tube and into the water by a force applied to the bottom or rear end by an extendable mast, not illustrated. Upon exiting the buoy tube, the spring forces the clamshell halves to separate and free the ice penetrator, allowing the penetrator to move upwardly and make contact with the overlying ice. The spring will also fall away and sink in the water.

In the unlikely event that buoy tube 5 leaks prior to deployment and water enters the buoy tube prematurely, water would also leak through the mating edges or seam 8 between the clam shell halves and comes into contact with the lithium, with which the water chemically reacts. One of the products of the reaction is lithium hydroxide, LiOH, a solid that is soluable in water, which is in addition to the hydrogen gas discussed in connection with the previous embodiment. Since the two shell halves are fitted together tightly within the buoy tube, the formed lithium hydroxide cannot be easily flushed away and dissolves in the water. As the reaction continues the remaining water that leaked into the clamshell contains greater and greater concentrations of lithium hydroxide. As this occurs the reaction slows down naturally, a phenomenon referred to as Le Chatelier's Principle. Hence the reaction is effectively self limiting; the reaction does not effectively continue and any likelihood of an explosive rapid reaction is avoided. As in the prior embodiment safety is enhanced.

Figure 3:
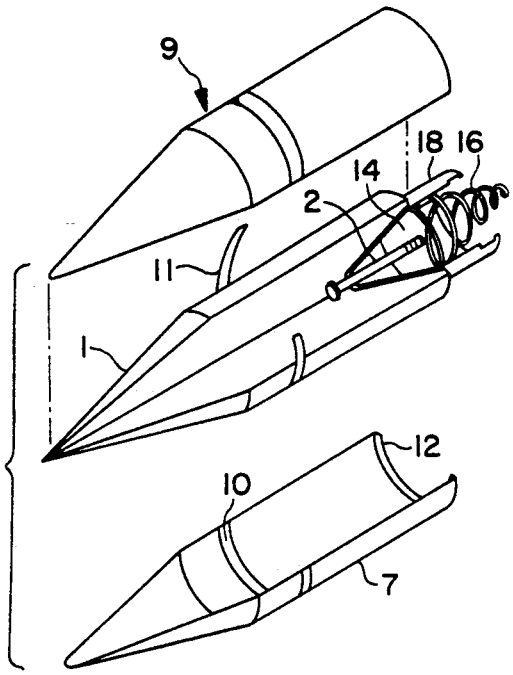
FIG. 3 illustrates an additional clam shell embodiment of the invention in smaller scale in exploded view.

A more practical version of such clam shell arrangement is presented in FIG. 3 to which reference may be made. The exploded perspective view shows clam shell halves 7 and 9, spring 11, penetrator 1, which is partially cut away. Spring 11 is partially wrapped around the cylindrical periphery of penetrator 1. For convenience a groove or indentation 10 may be formed in the inner cylindrical wall of shell half 7 and a like groove or indentation formed in the inner wall of the other shell half to form a seat for spring 11 at a predetermined position along the axis of the cylindrcal portion of the formed clam shell. This assists the assembler in retaining the spring in position when assembling the two clam shell halves together. In this version the bottom end of the clam shell is open. Each clam shell half contains a radially inwardly directed lip or flange portion 12, only one portion being illustrated, that forms a circular rim at the bottom end of the assembly to hold penetrator 1 in position. Penetrator base 2 is attached to a disc 14 which holds the antenna wire 16, partially illustrated. Further a cylindrical antenna sheath 18, illustrated partially cut away, is mounted coaxial with the penetrator and abutts against flange portion 12. The disk and antenna sheath closes the end of the clam shell.

Figure 4:
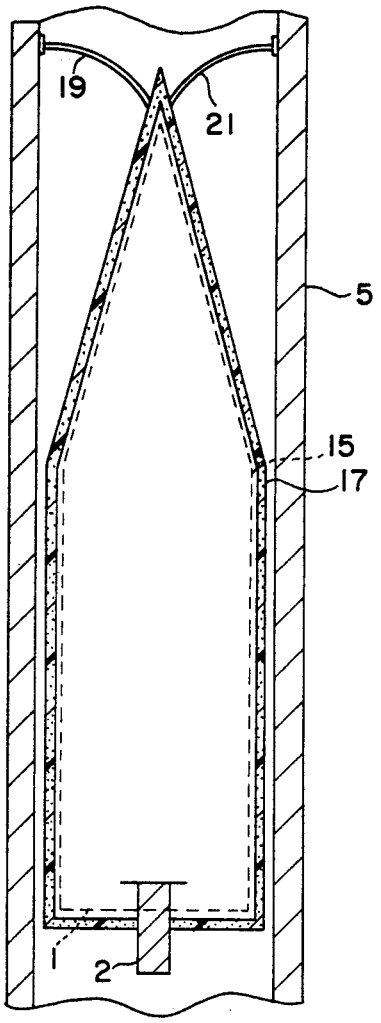
FIG. 4 illustrates a banana skin embodiment of the invention.

In another alternative form of the protective apparatus, illustrated in FIG. 4, the ice penetrator is completely encased in an air tight fluid tight wrapping. As shown in section penetrator 1 is covered initially by a plastic wrap 15, which is non-reactive with the lithium, and that covering is followed by a layer of wax 17, suitably conventional bee's wax available as yellow bee's wax U.S.P./NF CAS NO. 8012-89-3. Suitably the wrap is a clingable type such as the familiar Saran wrap marketed in grocery stores. Two pairs of elongate strips are included at opposite sides of the penetrator.

In forming the fluid tight assembly, the penetrator is wrapped with the plastic wrapping material from the bottom up, leaving the ends of the strips as extending tabs 19 and 21. Thereafter the assembly is repeatedly dipped into molten bee's wax to build up an overlaying wax layer to the desired thickness, much the same process used to form candles, leaving the tabs uncovered. Each time the assembly is dipped a coating of liquid wax is formed on the surfaces. When withdrawn the coating solidifies. The assembly is again dipped and withdrawn adding more coating. This dipping process is repeated until the desired thickness is reached. As example a coating of one-sixteenth inch in thickness may be built up onto a 0.005 inch thick plastic wrap.

As a consequence the casing is fluid tight and does not permit any water to contact the penetrator, thereby avoiding the possibility of a chemical reaction should the buoy tube be prematurely filled with water. It is appreciated that the components to this alternative embodiment are readily available and are very inexpensive.

As shown in FIG. 4, the tabs are fastened to opposite sides of the buoy tube by a tack weld to the side of the buoy housing, by bonding a ring or bulk head to the housing side and attaching tabs to such ring or bulk head. Upon deployment an expelling force from an extendable mast, not illustrated, is applied to the bottom of the assembly; hence, to the bottom of the penetrator, while the tab ends are restrained by the buoy tube. With sufficient force exerted by an extensible column, not illustrated, in the buoy, the penetrator is forced out of the protective package, and the tabs effectively peel back the wrapping, much akin to peeling a banana.

Figure 5:
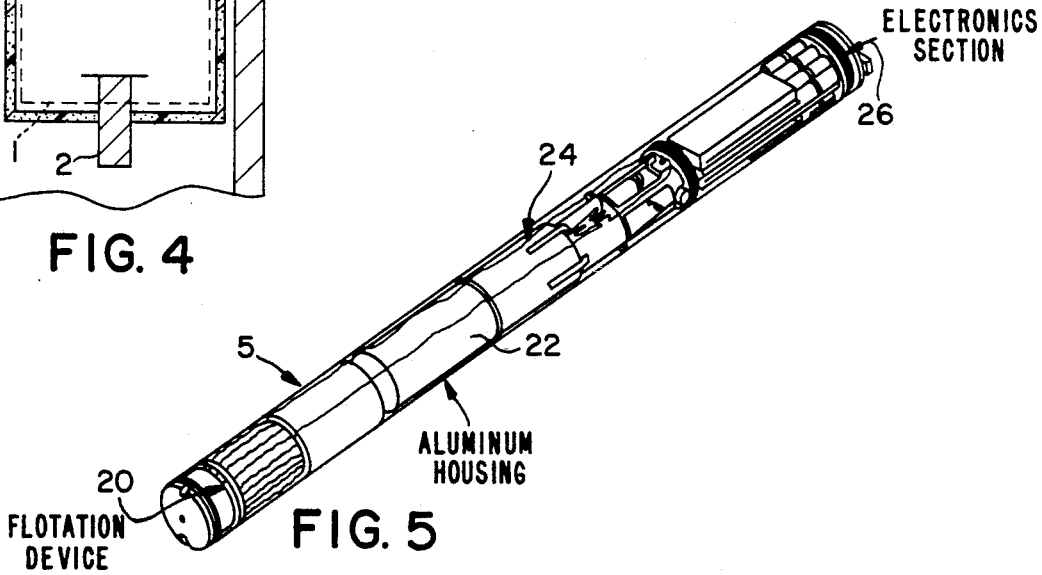
FIG. 5 partially illustrates in reduced scale a buoy tube assembly containing an improved penetrator.

Although not necessary to an understanding of the invention, an illustration of a buoy tube assembly is provided in FIG. 5. In this view the outline of tube 5 is presented in invisible lines thereby revealing the arrangement of the affordescribed penetrators, particularly the penetrator of FIG. 3, in site. The assembly includes a floatation device 20, penetrator assembly 22, representing the outer view of clam shell halves 7 and 9, an estendable mast 24 and the bottomost electronics section 26. Tube 5 is conveniently sized to fit within a submarine's torpedo tube. As the foregoing are known elements they are not described further.

It is believed that the foregoing description of the preferred embodiments of the invention is sufficient in detail to enable one skilled in the art to make and use the invention. However, it is expressly understood that the details of the elements which are presented for the foregoing enabling purpose are not intended to limit the scope of the invention, in as much as equivalents to those elements and other modifications thereof, all of which come within the scope of the invention, become apparent to those skilled in the art upon reading this specification. Thus the invention is to be broadly construed within the full scope of the appended claims.

What is claimed is:

1. An improved thermochemical ice penetrating apparatus of the type including a thermochemical ice penetrator formed of a material that is chemically reactive to water and a buoy tube for storing said ice penetrator and through which said ice penetrator is released into water for buoyant upward movement into contact with ice overlying the water, comprising in combination therewith:

protective means for preventing an explosive sound producing chemical reaction between water and the material of said thermochemical ice penetrator;

said protective means comprising a material arranged at least partially covering said ice penetrator and removable therefrom to form a unitary assembly preliminary to deployment with said protective mean's material being non-reactive to the material of said ice penetrator and to water, whereby any water entering said buoy tube cannot react violently with the ice penetrator stored therewithin; and said protective means being withdrawn from said covering relationship upon and after release from said buoy tube.

2. The invention as defined in claim 1, wherein said thermochemical ice penetrator comprises top and bottom ends and sides; and wherein said protective means further comprises:

a receptacle for receiving therewith and covering essentially the top end and sides of said penetrator to thereby form a physical barrier;

said receptacle having an open end through which to receive said penetrator within the receptacle to thereby store said penetrator with all sides, excepting the bottom end, being covered by said receptacle, leaving said bottom end of said ice penetrator exposed;

said receptacle having an inner geometry and size essentially conforming to the outer geometry and size of said penetrator to provide minimal clearance therebetween and define a clearance region between outer surfaces of said penetrator and inner surfaces of said receptacle with said clearance region being exposed at said open end of said receptacle to permit any fluid or gas ingress into or egress from said clearance region only from said receptacle end;

said protective means being received within said buoy tube; whereby any flooding of water within said buoy tube and thereby into said clearance region within said receptacle produces a self limiting gas producing reaction between said water and said ice penetrator to force remaining water out of said receptacle, whereby further reaction with said water is stifled.

3. The invention as defined in claim 2 wherein said ice penetrator comprises the material lithium and wherein said material of said protective means comprises stainless steel.

4. The invention as defined in claim 1, wherein said protective means further comprises:

a clamshell container having two mating parts to define a closed confining region for snugly receiving and holding said ice penetrator and form a unitary assembly therewith;

said container comprising a nylon material;

biasing means within said container located between said ice penetrator and said container for exerting a separating force on said clam shell portions and push said halves against said buoy tube with minimal physical separation between said halves, so that only minimal sized physical gaps are created between said halves;

whereby the byproducts of reaction between water leaking from said buoy tube into said container and said ice penetrator accumulate to a sufficient degree within said container region to inhibit further reaction with said ice penetrator and thereby prevent a sound producing reaction.

5. The invention as defined in claim 4, wherein said biasing means comprises a spring.

6. The invention as defined in claim 5, wherein said spring comprises a flat spring.

7. The invention as defined in claim 1, wherein said protective means comprises:

encasement means for encasing said ice penetrator in a fluid tight relationship to prevent any water residing in said buoy tube from contacting said ice penetrator, said encasement means comprising a material that is non-reactive to said ice penetrator and to water and forming a unitary assembly with said ice penetrator with said encasement means being removable from said ice penetrator responsive to application of a disassembling force.

8. The invention as defined in claim 7, wherein said encasement means comprises:

a plastic wrap for encasing said ice penetrator;

a layer of bees wax overlying said plastic wrap, whereby said ice penetrator is encased to prevent contact of said ice penetrator with any fluid that enters said buoy tube;

a pair of tabs; said tabs being mechanically coupled to opposed portions of said plastic wrap; and means fastening the ends of said tabs to opposed positions on said buoy tube to physically restrain said tabs;

whereby a force applied to a bottom end of said ice penetrator to push said ice penetrator out of said buoy tube, simultaneously provides an unpeeling force upon said encasement means for unpeeling said encasement means from said ice penetrator to permit said ice penetrators release into water.

9. The invention as defined in claim 8 wherein said plastic wrap comprises "Saran" brand Wrap.

10. Thermochemical ice penetrating apparatus, comprising:

a thermochemical ice penetrator, having top and bottom ends and sides;

a receptacle for receiving therewith and solidly covering essentially the top end and sides of said penetrator;

said receptacle having an open end through which to receive said penetrator within the receptacle to thereby store said penetrator with all sides, excepting the bottom end, being covered by said receptacle;

said receptacle having an inner geometry and size essentially conforming to the outer geometry and size of said penetrator to provide minimal clearance therebetween and define a region between outer surfaces of said penetrator and inner surfaces of said receptacle with said clearance region being exposed at said open end of said receptacle to permit any fluid or gas ingress into or egress from said clearance region only from said receptacle end;

said receptacle being of a material that is non-reactive to the material of said ice penetrator and to water;

a buoy tube forming a cylindrical passage to store and through which to release said receptacle and the latters covered ice penetrator into the water, wherein the penetrator is also released from said receptacle;

said receptacle being received within said buoy tube; whereby any flooding of water within said buoy tube and thereby into said clearance region within said receptacle produces a self limiting gas producing reaction between said water and said ice penetrator to force remaining water out of said receptacle, whereby the reaction with said water is inhibited.

11. In an ice penetration apparatus, the combination comprising:

a thermochemical ice penetrator formed of a reactive material that is reactive with water, such as lithium;

a clamshell container having two mating parts to define a closed confining inner region for snugly receiving an ice penetrator;

said container being formed of a material that is non-reactive with the material of said ice penetrator and with water;

a buoy tube;

biasing means within said container located between said penetrator and said container for exerting a separating force on said clam shell portions and push said portions against the inner wall of said buoy tube with minimal physical separation between said halves, whereby only minimal sized physical gaps are created between said halves to restrict fluid flow between the inner region within said container and the bouy tube confining said container;

whereby said clam shell essentially confines the fluid products of any reaction between any water that leaks from said bouy tube into said clam shell with said ice penetrator to increase the concentration of such reaction product in the water to a degree sufficient to reduce the rate of continuing reaction between water and said ice penetrator thereby resulting in a self limiting reaction.

12. The invention as defined in claim 11 wherein said container material comprises nylon material.

13. In an ice penetration apparatus containing a thermochemical ice penetrator and a buoy tube, the combination comprising:

a plastic wrap for encasing said ice penetrator;

a layer of bees wax overlying said plastic wrap, whereby said ice penetrator is encased to prevent contact of said ice penetrator with any fluid that enters said buoy tube;

a pair of tabs; said tabs being mechanically coupled to opposed portions of said plastic wrap; and means fastening the ends of said tabs to opposed positions on said buoy tube to physically restrain said tabs;

to thereby permit a force applied to a bottom end of said ice penetrator to push said ice penetrator out of said buoy tube, while simultaneously to provide an unpeeling force upon said wrapping for unpeeling said plastic wrap and overlying bees wax from said ice penetrator, the latter of which remain restrained by said tabs, whereby said ice penetrator is released into and is exposed to fluid.

14. The invention as defined in claim 13 wherein said wrap comprises "Saran" brand wrap.

* * * * *